US006634347B2

(12) United States Patent
Holler

(10) Patent No.: US 6,634,347 B2
(45) Date of Patent: Oct. 21, 2003

(54) HIGH IMPACT BOW AND ASSOCIATED METHODS

(76) Inventor: Christopher A. Holler, 301 S. Orlando Ave., Suite 200, Maitland, FL (US) 32751

( * ) Notice: Subject to any disclaimer, the term of this patent is extended or adjusted under 35 U.S.C. 154(b) by 0 days.

(21) Appl. No.: 09/976,242

(22) Filed: Oct. 12, 2001

(65) Prior Publication Data

US 2003/0070668 A1 Apr. 17, 2003

(51) Int. Cl.[7] ..... F41B 5/00
(52) U.S. Cl. ..... 124/23.1
(58) Field of Search ..... 124/23.1, 25.6, 124/88

(56) References Cited

U.S. PATENT DOCUMENTS

| | | | | | |
|---|---|---|---|---|---|
| 586,713 | A | | 7/1897 | Peters | |
| 785,050 | A | | 3/1905 | Saunders | |
| 3,038,830 | A | * | 6/1962 | Groves | 124/23.1 |
| 3,196,860 | A | | 7/1965 | Hoyt, Jr. | 124/24 |
| 3,265,055 | A | | 8/1966 | Gage | 124/24 |
| 3,552,373 | A | | 1/1971 | Van Hecke | 124/24 |
| 3,625,193 | A | * | 12/1971 | Palma | 124/23.1 |
| 3,802,410 | A | * | 4/1974 | Palma | 124/23.1 |
| 3,965,883 | A | | 6/1976 | Meyer | 124/24 |
| 4,020,819 | A | | 5/1977 | Haines | 124/23 |
| 4,078,537 | A | | 3/1978 | Carella | 124/24 |
| 4,244,345 | A | | 1/1981 | Simo et al. | 124/24 |
| 4,287,867 | A | | 9/1981 | Islas | 124/24 |
| 4,338,909 | A | | 7/1982 | Plummer | 124/16 |
| 4,365,611 | A | * | 12/1982 | Nishioka | |
| 4,478,202 | A | | 10/1984 | Anderson | 124/23 |
| 4,530,342 | A | | 7/1985 | Simo | 124/24 |
| 4,644,928 | A | | 2/1987 | Studanski | 124/24 |
| 4,671,249 | A | * | 6/1987 | Troncoso | 124/23.1 |
| 4,858,588 | A | | 8/1989 | Bozek | 124/23 |
| 5,024,206 | A | | 6/1991 | Lester | 124/23 |
| 5,243,956 | A | | 9/1993 | Luehring | 124/86 |
| 5,454,361 | A | | 10/1995 | Bronnert | 124/23.1 |
| 5,499,618 | A | | 3/1996 | Thompson | 124/25.6 |
| 5,651,354 | A | | 7/1997 | La Haise, Sr. | 124/23.1 |
| 5,720,268 | A | | 2/1998 | Koltze | 124/25 |

* cited by examiner

*Primary Examiner*—John A. Ricci
(74) *Attorney, Agent, or Firm*—Allen, Dyer, Doppelt, Milbrath & Gilchrist, P.A.

(57) ABSTRACT

A high impact bow for firing an elongate arrow is provided. The system includes a high impact bow having a grip member, an upper arm extending outwardly from an upper end portion of the grip member and having a first predetermined length, and a lower arm extending outwardly from a lower end portion of the grip member and having a second predetermined length that is substantially shorter than the first predetermined length of the upper arm to thereby define the upper arm as a longer upper arm and the lower arm as a shorter lower arm. The high impact bow also includes a draw string connected to distal end portions of the longer upper arm and the shorter lower arm. Another embodiment of the high impact bow includes a first bow, a first connector positioned adjacent the first bow, a second bow having a second connector positioned to matingly engage the first connector, and a pair of compound draw strings positioned to connect portions of the second bow to portions of the first bow so that the combination of the first and second bows form a compound bow.

13 Claims, 5 Drawing Sheets

HIGH IMPACT BOW AND ASSOCIATED METHODS

FIELD OF THE INVENTION

The present invention relates to the field of archery, and more particularly, to the field of bows and associated methods.

BACKGROUND OF THE INVENTION

Archery equipment, namely bows, can generally be divided into two separate fields, simple bows 90, i.e., traditional long bows, as illustrated in FIG. 1, and compound bows. Compound bows are designed to provide a greater effective draw length than simple bows and therefore allow an arrow to be fired faster and farther than when fired from a simple bow. Simple bows 90 generally include a grip member 96 that is positioned midway between the upper arm 92 and the lower arm 94 of the simple bow 90. Simple bows 90 are therefore disadvantageous because they cannot be used to fire arrows at targets positioned at great distances. Simple bows can also disadvantageously add difficulty to the targeting process. Simple bows that are designed to fire arrows at greater speeds generally include draw strings having greater tensions. This disadvantageously makes the process of extending, i.e., pulling back, the draw string very difficult.

Simple bows have become somewhat developed to account for some difficulties encountered with targeting such as twisting of an arrow when fired. For example, U.S. Pat. No. 3,956,883 titled "Archery Bow" by Meyer discloses a bow having recurved limbs. The archery bow disclosed in Meyer, however, is still cumbersome and still only provides mediocre firing ranges that are similar to traditional simple bows.

Compound bows, such as that shown in U.S. Pat. No. 4,858,488 titled "Archery Device with Separate Bending and Launching Bowstrings and Front End Arrow Launch" by Bozek can be very cumbersome, i.e., extremely long and heavy, and can also be very complicated to use. Compound bows can also be very expensive. Further, if an owner of a simple bow decides to purchase a compound bow, that owner often no longer has any use for the simple bow.

SUMMARY OF THE INVENTION

With the foregoing in mind, the present invention advantageously provides a high impact bow system, a high impact bow, and associated methods for firing an elongate arrow at an increased rate of travel. The present invention also advantageously provides conversion of a simple bow, i.e., traditional long bow, into a compound bow. The high impact bow is advantageously simple and uncomplicated to use and is also light in weight. The high impact bow system of the present invention provides the advantages of a compound bow, i.e., allows for faster and farther travel of an elongate arrow, while still providing the advantageous simplicity and light weight use of a simple bow.

More particularly, the present invention provides a high impact bow system for firing an elongate arrow. The high impact bow system preferably includes a high impact bow having a grip member. The grip member preferably includes an upper end portion and a lower end portion positioned substantially opposite the upper end portion. The high impact bow also preferably includes an upper arm extending outwardly from the upper end portion of the grip member.

The upper arm has a distal end portion and a first predetermined length. The high impact bow further preferably includes a lower arm extending outwardly from the lower end portion of the grip member. The lower arm likewise has a distal end portion and a second predetermined length that is substantially shorter than the first predetermined length of the upper arm to thereby define the upper arm as a longer upper arm and the lower arm as a shorter lower arm. The high impact bow also preferably includes a draw string connected to the distal end portions of the longer upper arm and the shorter lower arm. The high impact bow system further preferably includes an elongate arrow adapted to be fired at a high rate of travel from the high impact bow.

The present invention also advantageously includes a high impact bow for firing an elongate arrow at a high rate of travel. The high impact bow preferably includes a grip member having an upper end portion and a lower end portion positioned substantially opposite the upper end portion. The high impact bow also preferably includes an upper arm extending outwardly from the upper end portion of the grip member. The upper arm preferably includes a distal end portion and a first predetermined length. The high impact bow further preferably includes a lower arm extending outwardly from the lower end portion of the grip member. The lower arm preferably includes a distal end portion and a second predetermined length that is substantially shorter than the first predetermined length of the upper arm. The high impact bow further preferably includes a draw string connected to the respective distal end portions of the upper arm and the lower arm.

The present invention also advantageously includes a high impact bow for firing an elongate arrow having a first bow including a grip member having an upper end portion and a lower end portion positioned substantially opposite the upper end portion. The first bow also includes an upper arm extending outwardly from the upper end portion of the grip member and a lower arm extending outwardly from the lower end portion of the grip member. The upper and lower arms include distal end portions. The first bow further includes a primary draw string connected to the respective distal end portions of the upper and lower arms. The high impact bow also preferably includes a first connector portion positioned adjacent the grip member along a medial body portion of the first bow, a second bow having a medial body portion, an upper arm extending at a first predetermined angle outwardly from the medial body portion and including a distal end portion, and a lower arm extending at a second predetermined angle outwardly from the medial body portion and having a distal end portion positioned substantially opposite the distal end portion of the upper arm. The second bow also preferably includes a second connector positioned adjacent the medial body portion and adapted to matingly engage the first connector positioned adjacent the grip member of the first bow. The high impact bow further preferably includes a pair of compound draw strings. The first one of the pair of compound draw strings is an upper compound draw string connected between the respective distal end portions of the respective upper arms of the first and second bow. The second one of the pair of compound draw strings preferably is a lower compound draw string connected between the respective distal end portions of the respective lower arms of the first and second bow so that the combination of the first and second bows form a compound bow.

The present invention still further advantageously includes a method of firing an elongate arrow from a high impact bow. The method preferably includes gripping a high impact bow along a lower portion of the body thereof. The method also preferably includes engaging the elongate arrow with a draw string of the high impact bow, and pulling the draw string back along the lower portion of the body of the high impact bow so that the draw string can be drawn further than if drawn from a medial portion of the body of the high impact bow.

The present invention also advantageously includes a method of using a high impact bow. The method preferably includes matingly connecting a first connector of a first bow to a second connector of a second bow, and connecting respective distal end portions of respective upper and lower arms of the respective first and second bows with respective upper and lower compound draw strings.

The present invention advantageously allows a user, i.e., an archer, to draw an elongate arrow further back with a draw string than is possible with a traditional simple bow. This advantageously allows an elongate arrow to be fired faster and farther than a traditional arrow fired from a simple bow. The present invention is also economically advantageous because it allows a user to convert a simple bow into a compound bow, thereby eliminating the need for purchasing a compound bow.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF THE PREFERRED EMBODIMENTS

Figure 1:
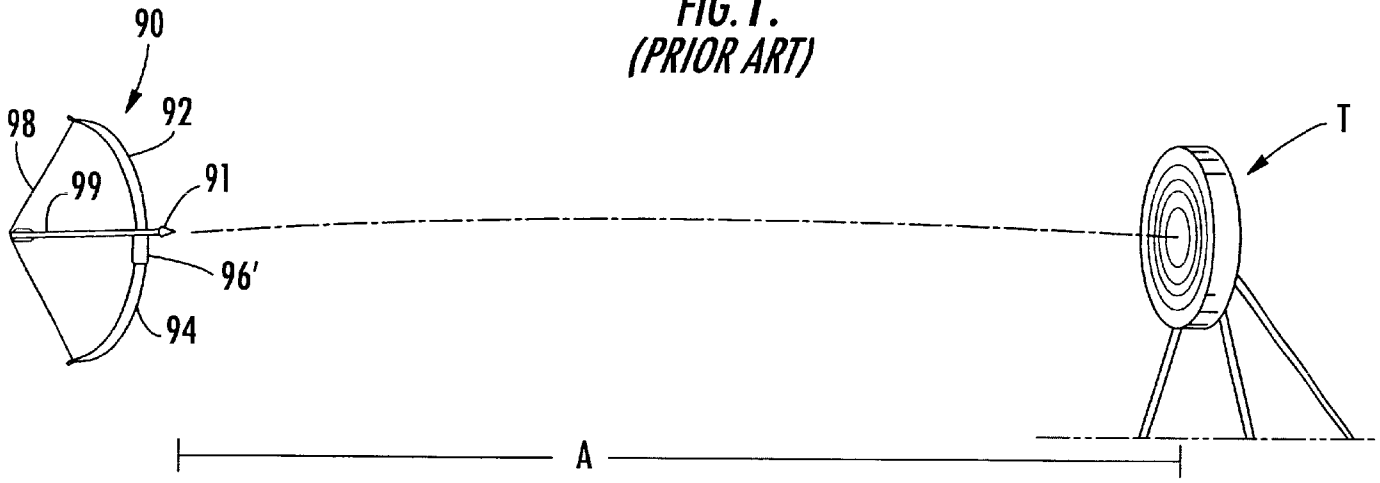
FIG. 1. (PRIOR ART)
FIG. 1 is an environmental view of an elongate arrow being fired from a prior art simple bow according to the present invention.

The present invention will now be described more fully hereinafter with reference to the accompanying drawings which illustrate preferred embodiments of the invention. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, the prime notation, if used, indicates similar elements in alternative embodiments.

As illustrated in FIGS. 1–11, the present invention advantageously provides a high impact bow system 20, a high impact bow 22, and associated methods for firing an elongate arrow 26 at increased speed and along an increased distance. As perhaps best illustrated in FIG. 4, the high impact bow system 20 advantageously includes a high impact bow 22 and an elongate arrow 26. The high impact bow 22 of the present invention and of the high impact bow system 20 can advantageously include a grip member 30. The grip member 30 advantageously includes an upper end portion 32 and a lower end portion 34 positioned substantially opposite the upper end portion 32. The grip member 30 can be made of a rubber material, or any other material that allows a user, i.e., an archer, to hold portions of the grip member 30 in a manner that enhances friction so that the grip member 30 will not slip when being used by the archer. The grip member 30 can advantageously include a first side 31 positioned closely adjacent a user so that the user can grip the high impact bow 22. The grip member 30 can also advantageously include a second side 33 positioned substantially opposite the first side 31.

The upper end portion 32 of the grip member 30 can advantageously be substantially flat so that an elongate arrow 26 can be positioned to rest thereon before being fired. This advantageously allows a user to better aim the elongate arrow 26 towards a desired target T. The flat portion 36 of the grip member 30 can also advantageously provide a point of separation between the elongate arrow 26 and the user's hand so that when the elongate arrow 26 is fired it does not cause injury to the user's hand.

Figure 3:
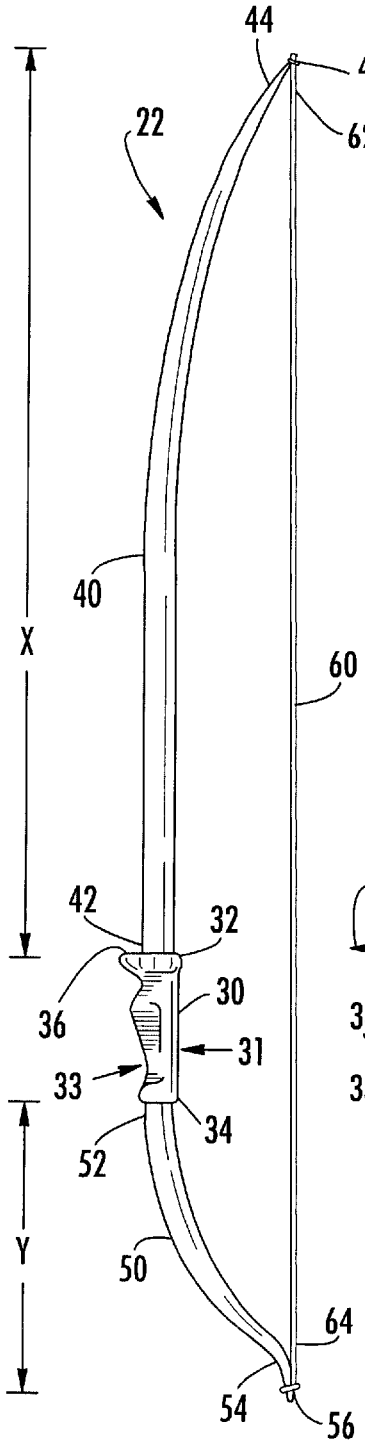
FIG. 3 is a side elevation view of a high impact bow according to the present invention.
Figure 4:
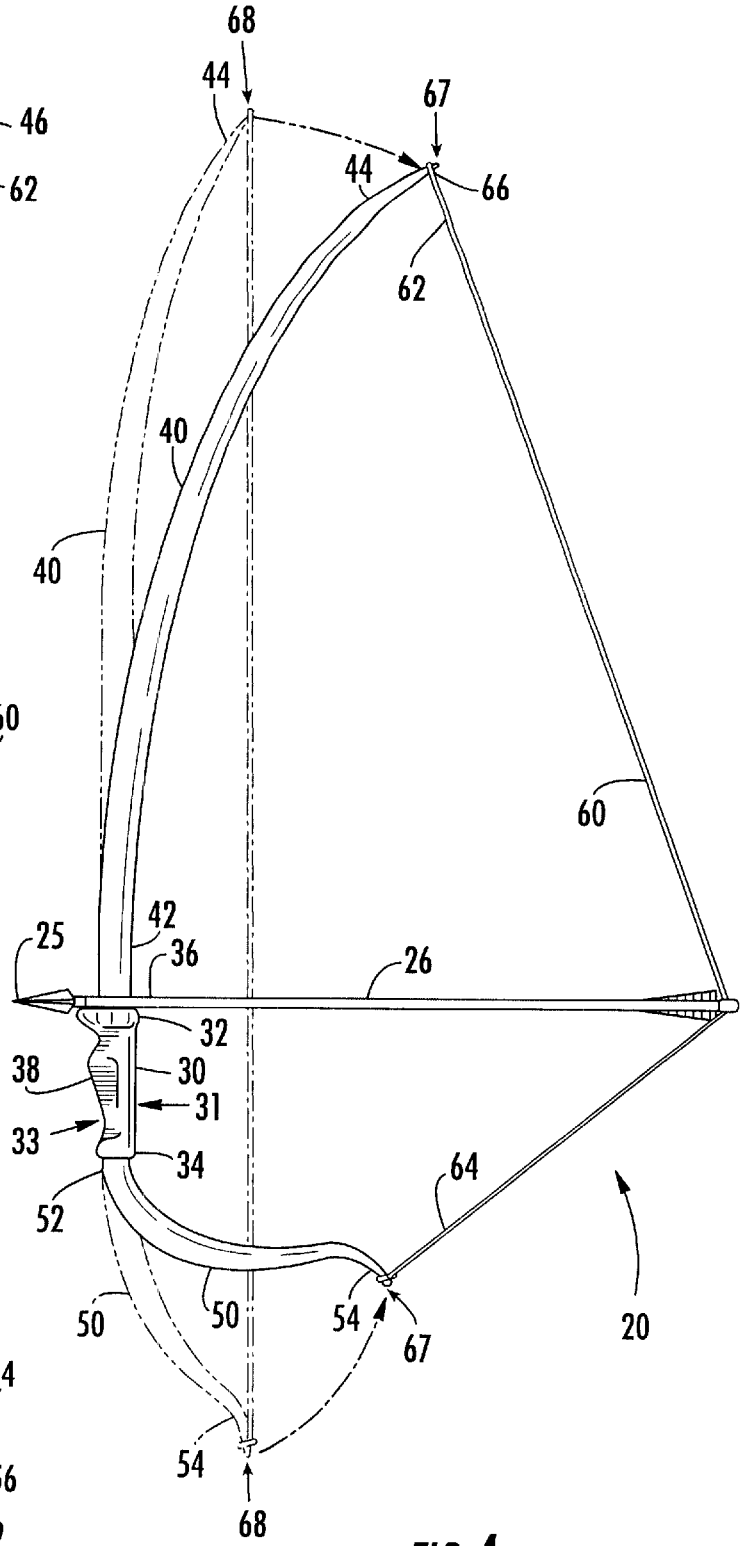
FIG. 4 is a side elevation view of a high impact bow system including a high impact bow with the draw string extended and having an elongate arrow positioned therein according to the present invention.

As perhaps illustrated in FIGS. 3–4, the high impact bow 22 of the present invention and of the high impact bow system 20 can also advantageously include an upper arm 40 extending outwardly from the upper end portion 32 of the grip member 30. The upper arm 40 can include a proximal end portion 42 and a distal end portion 44. The proximal end portion 42 is positioned adjacent the upper end portion 32 of the grip 30. The distal end portion 44 is positioned substantially opposite the proximal end portion 42 of the upper arm 40. The upper arm 40 preferably has a first predetermined length X. The first predetermined length X can, for example, be between 3–6 feet.

The high impact bow 22 can also advantageously include a lower arm 50 extending outwardly from the lower end portion 34 of the grip member 30. The lower arm so can also advantageously include a proximal end portion 52 and a distal end portion 54. The proximal end portion 52 of the lower arm 50 is positioned adjacent the lower end portion 34 of the grip member 30. The distal end portion 54 of the lower arm 50 is positioned substantially opposite the proximal end portion 52 of the lower arm 50. The distal end portion 54 of the lower arm 50 is further positioned substantially opposite the distal end portion 44 of the upper arm 40. The lower arm 50 preferably has a second predetermined length Y. The second predetermined length Y preferably is substantially shorter than the first predetermined length X of the upper arm 40. The first predetermined length X of the upper arm 40, therefore, defines the upper arm 40 as a longer upper arm and the second predetermined length Y of the lower arm 50, therefore, defines the lower arm 50 as a shorter lower arm. The second predetermined length Y, for example, can be between 1–2 feet.

The upper and lower arms 40, 50 can advantageously be made of a light-weight, strong, and flexible material, such as fiberglass, for example, or any other material having similar strength and flexibility properties as understood by those skilled in the art. The upper and lower arms 40, 50 can also advantageously be adapted to matingly engage portions of the grip member 30. For example, as understood by those skilled in the art, the upper end portion 32 of the grip member 30 can include an upper cavity, i.e., opening, adapted to receive the proximal end potion 42 of the upper arm 40. Similarly, the lower end portion 34 of the grip member 30 can also include a lower cavity, i.e., opening, adapted to receive the proximal end portion 52 of the lower arm 50. The proximal end portions of the upper and lower arms 42, 52 can be inserted into the respective upper and lower cavities of the grip member 30 and secured with an adhesive, for example. The proximal end portions of the upper and lower arms 42, 52 can also advantageously be secured into the respective upper and lower cavities of the grip member 30 using a fastener, such as a screw, positioned to extend through a hole formed in a medial body portion 38 of the grip member 30, or any other fastener as understood by those skilled in the art. The screw can be adjusted so that a predetermined amount of tension is applied to the proximal end portions of the upper and lower arms 42, 52 so that the proximal end portions 42, 52 are fixed within the upper and lower cavities of the grip member 30. Similarly, a hole can also be formed in a portion of the proximal end portions of the upper and lower arms 42, 52 and the screw can then be passed through the hole formed in the grip member 30 and into the hole formed in the proximal end portions of the upper and lower arms 42, 52 to thereby secure the proximal end portions of the upper and lower arms 42, 52 into the upper and lower cavity of the grip member 30.

The high impact bow 22 can also advantageously include a draw string 60 connected to the distal end portions of the upper and lower arms 44, 54. The draw string 60 can advantageously include an upper end portion 62 corresponding to the distal end portion 44 of the upper arm 40 and a lower end portion 64 corresponding to the distal end portion 54 of the lower arm 50.

Figure 10:
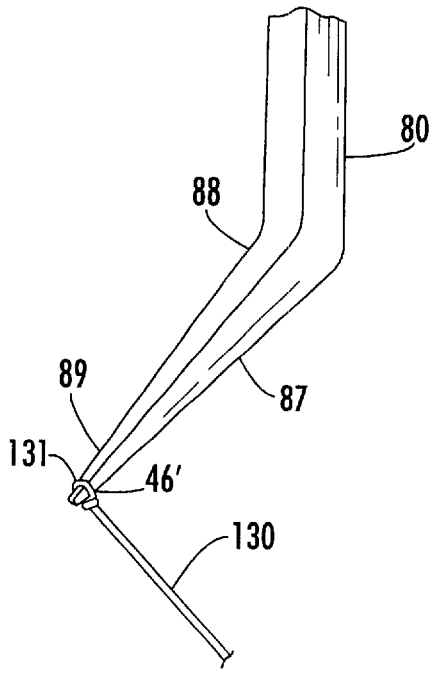
FIG. 10 is a fragmentary perspective view of a draw string connected to a distal end portion of an upper or lower arm of a bow according to the present invention.
Figure 11:
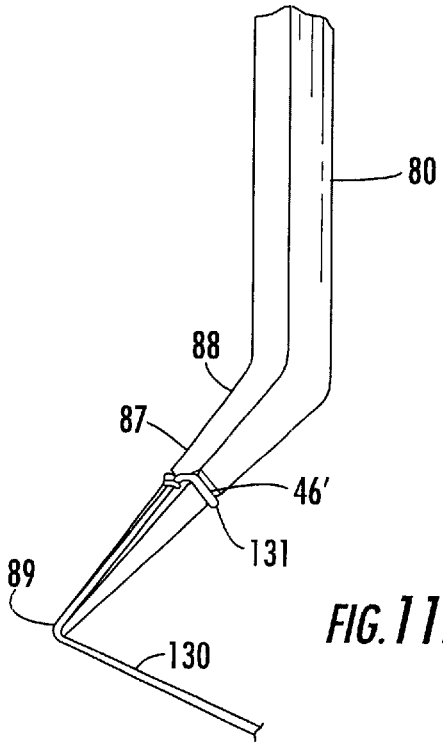
FIG. 11 is a fragmentary perspective view of another connection of a drawstring to a distal end portion of an upper or lower arm of a bow according to the present invention.

As illustrated in FIGS. 10–11, the distal end portions of the upper and lower arms 44, 54 can each advantageously include a draw string receiver 46, 56 for receiving the respective upper and lower end portions 62, 64 of the draw string 60. The draw string receivers 46, 56 can advantageously be provided by a notch, for example, formed in the distal end portions of the upper and lower arms 44, 54 of the high impact bow 22. The draw string 60 can then be positioned to engage the draw string receivers 46, 56 so that the draw string 60 is secured to the distal end portions of the upper and lower arms 44, 54. The upper and lower ends of the draw string 62, 64 can each advantageously include a loop 66, for example, that can be positioned over the distal end portions of the upper and lower arms 44, 54. The loops 60 can also advantageously engage the draw string receivers 46, 56 to thereby secure the draw string 60 to the distal end portions of the upper and lower arms 44, 54. The draw string 60 can advantageously be nylon, for example, other synthetic fibers, natural fibers, or any other highly flexible and strong material as understood by those skilled in the art.

As illustrated in prior art FIG. 1, a traditional simple bow 90, i.e., a long bow, has a grip 96 that is positioned midway between the upper arm 92 and the lower arm 94. The grip member 33 of the high impact bow 22 of the present invention, however, is advantageously positioned closer, and more preferably substantially closer, to the distal end portion of the lower arm 54 than it is to the distal end portion of the upper arm 44. This configuration advantageously allows an elongate arrow 26 fired from the high impact bow to travel faster and farther than an arrow fired from a simple bow.

Figure 2:
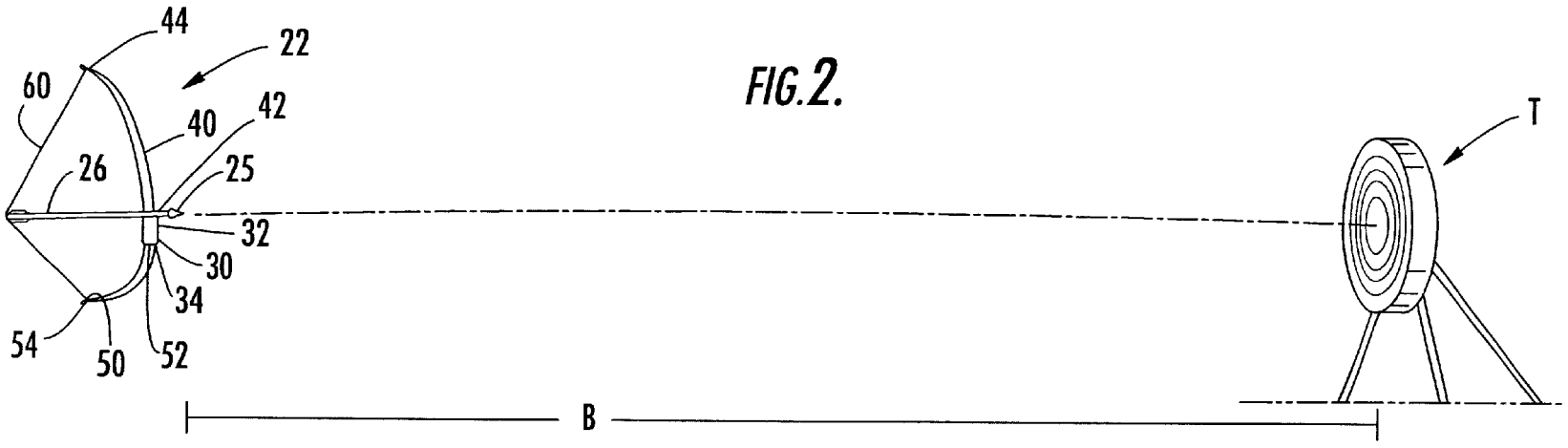
FIG. 2 is an environmental view of an elongate arrow being fired from a high impact bow according to the present invention.

As perhaps best illustrated in FIGS. 1–2, an elongate arrow 26 fired from a prior art bow 90 will only travel a first predetermined distance A while an elongate arrow 26 fired from the high impact bow 22 of the present invention will advantageously travel a second, longer, predetermined distance B. For example, since the lower arm 50 is substantially shorter than the upper arm 40, as described above, the grip member 30 is positioned closer to the distal end portion of the lower arm 54. Therefore, the draw on the draw string 60 can advantageously be increased, i.e., the draw string 60 can be pulled back a distance greater than that capable with a simple prior art bow 90. When the draw string 60 is pulled back a greater distance, then the potential energy of the draw string 60 is increased, i.e., the draw string 60 can advantageously be in contact with portions of the elongate arrow 26 for a longer period of time when being fired, thereby increasing the transfer of potential energy to kinetic energy upon release of the draw string 60 and subsequent firing of the elongate arrow 26.

As noted above, the upper and lower arms 40, 50 can advantageously be formed of a highly flexible but strong material, such as fiberglass, wood, plastic, or other synthetic material for example. The lower arm 50, however, is preferably formed of a material that is more flexible than the upper arm 40. This advantageously allows the shorter lower arm 50 to be more flexible than the longer upper arm 40. When the draw string 98 is pulled back in a prior art simple bow 90, i.e., a traditional long bow having the grip member 96 positioned midway between the upper 92 and lower 94 arms, the upper 92 and lower 94 arms are pulled back evenly. Therefore, the distance that the upper arm 92 and the lower arm 94 are displaced when the draw string 98 is pulled back in a prior art simple bow 90 is substantially similar. When pulling back the draw string 60 of the high impact bow 22 of the present invention, however, the location of the grip member 30 has an effect on the distance that the distal end portions of the upper and lower arms 44, 54 will be displaced, i.e., closer to the distal end portion of the shorter lower arm. Therefore, it is preferable that the shorter lower arm 50 be made of a more flexible material than the longer upper arm 40 so that the distal end portion 44, 54 of the shorter lower arm 50 can be displaced a greater percentage, but still the same distance, than the longer upper arm 40.

Since the shorter lower arm 50 of the high impact bow 22 is more flexible that the longer upper arm 40, a uniform tension can advantageously be applied to the draw string 60 when it is extended. The draw string 60 can be positioned between a tension enhanced position 67 and a tension released position 68. When the draw string 60 is drawn back, it is positioned in the tension enhanced position 67. When the draw string 60 is positioned in the tension enhanced position 67, an elongate arrow 26 can advantageously be positioned therein to be fired. The elongate arrow 26 can also be positioned to engage the draw string 60 when it is positioned in the tension released position 68. The draw string 60 can then be moved from the tension released position 68 to the tension enhanced position 67, i.e., from an at rest to a drawn back position. When the draw string 60 is extended, the tension applied to the draw string 60 is advantageously uniform, i.e., same tension throughout draw string 60. This occurs because of the greater flexibility of the shorter lower arm 50 of the high impact bow 22.

The high impact bow system 20 can also advantageously include an elongate arrow 26 adapted to be fired at a high rate of travel from the high impact bow 22. The elongate arrow 26 can advantageously have a length substantially longer than a traditional prior art arrow 99, as best illustrated in FIGS. 1–2. The elongate arrow 26 can also advantageously be formed of a light weight material, such as fiberglass for example, so that the elongate arrow 26 can travel a distance greater than a traditional prior art arrow 99. An elongate arrow 26 having a greater length than a traditional prior art arrow 99 will advantageously be more aerodynamic and therefore fly farther than an arrow having a shorter length 99. The tip 25 of the elongate arrow 26 can advantageously be heavier than the tip 91 of a prior art arrow 99. This advantageously adds to the aerodynamic design of the elongate arrow 26 so that the elongate arrow 26 can be fired faster and farther than the prior art arrow 99. Aerodynamic design is very important when using a light-weight arrow because very small factors effect the flight of light-weight arrows. For example, a slight breeze can have an effect on the flight of a light-weight arrow. Therefore, an arrow having a greater length is preferable to reduce the effects of such factors as wind and distance on the flight path of the elongate arrow 26.

As illustrated in FIGS. 5–11, in a second embodiment of the present invention, a high impact bow 22' can include a first bow 70 and a second bow 80 positioned to connect to portions of the first bow 70. The first bow 70 can advantageously include a grip member 30 including an upper end portion 32' and a lower end portion 34' positioned substantially opposite the upper end portion 32'. The upper end portion of the grip member 32' can advantageously be substantially flat so that an elongate arrow 26' can be positioned to rest thereon before being fired. The substantially flat portion of the grip member 36' advantageously allows a user to better aim the elongate arrow 26' towards a desired target. The flat portion of the grip member 36' can also advantageously provide a point of separation between the elongate arrow 26' and the user's hands so that when the elongate arrow 26' is fired it does not cause injury to the user.

The first bow 70 can also advantageously include an upper arm 72 extending outwardly from the upper end portion of the grip member 32'. The first bow 70 can further advantageously include a lower arm 74 extending outwardly from the lower end portion of the grip member 34'. The upper and lower arms 72, 74 can advantageously have a substantially similar size and shape.

The upper and lower arms of the first bow 72, 74 can advantageously include respective proximal 75, 77 and distal 76, 78 end portions. The proximal end portion of the upper arm 75 is positioned adjacent the upper end portion of the grip member 32' and the proximal end portion of the lower arm 77 is positioned adjacent the lower end portion of the grip member 34'. The distal end portion of the upper arm 76 is positioned substantially opposite the proximal end portion of the upper arm 75. Similarly, the distal end portion of the lower arm 78 is positioned substantially opposite the proximal end portion of the lower arm 76. The grip member 38' of the first bow 70 can advantageously be positioned midway between the distal end portions of the upper and lower arms 76, 78.

The first bow 70 can further advantageously include a primary draw string 100 having an upper end portion 102 and a lower end portion 104. The upper end portion of the primary draw string 102 can advantageously be adapted to connect to the distal end portion of the upper arm 76 and the lower end portion of the primary draw string 104 can advantageously be positioned to connect to the distal end portions of the lower arm 78. The distal end portions of the upper and lower arms 76, 78 can each advantageously include a draw string receiver 46', 56' for receiving the respective upper and lower end portions of the primary draw string 102, 104. The draw string receivers 46', 56' can advantageously be a notch, for example, formed in the distal end portions of the upper and lower arms of the first bow 76, 78. The primary draw string 100 can then be positioned to engage the draw string receivers 46', 56' so that the primary draw string 100 is secured to the distal end portions of the upper and lower arms 76, 78. The upper and lower ends of the primary draw string 102, 104 can each advantageously include a loop 106, for example, that can be positioned over the distal end portions of the upper and lower arms 76, 78. The loops 106 can also advantageously engage the draw string receivers 46', 56' to thereby secure the primary draw string 100 to the distal end portions of the upper and lower arms 76, 78. The primary draw string 100 can advantageously be nylon, for example, or any other highly flexible and strong material as understood by those skilled in the art.

Figure 9:
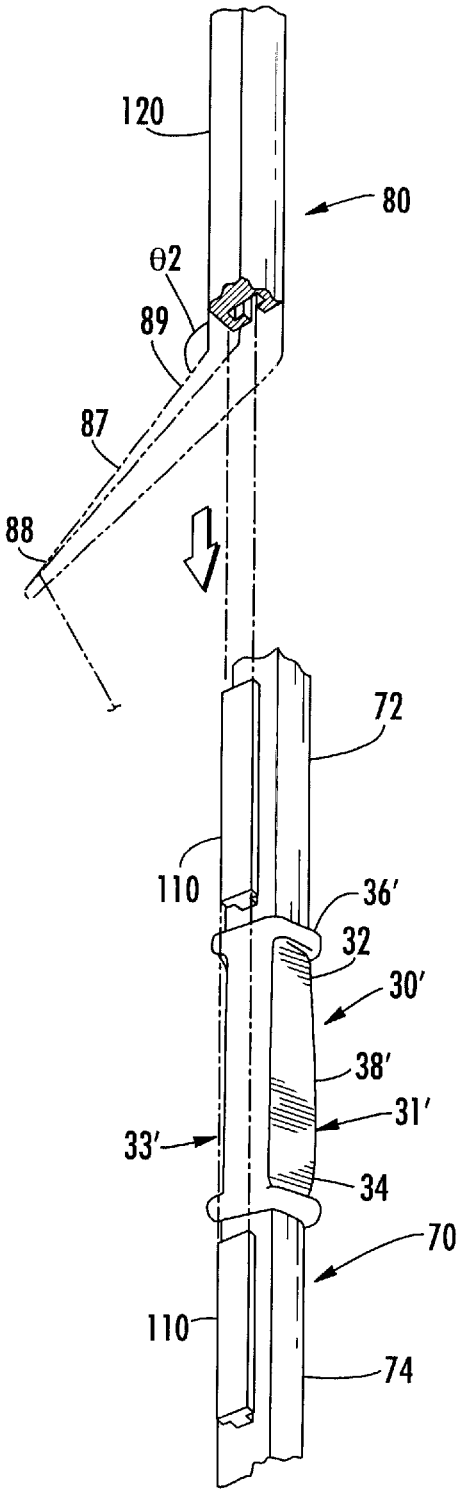
FIG. 9 is a fragmentary perspective view of a first connector engaging a second connector according to the present invention.

As best illustrated in FIG. 9, the high impact bow 22' can also advantageously include a first connector portion 110 positioned adjacent the grip member 38' along a medial body portion of the first bow 70. The first connector portion 110 can advantageously be connected to the first bow 70 using a fastener, such as a screw positioned to extend through portions of the grip member 38' for example, or any other fastener as understood by those skilled in the art. The first connector portion 110 can advantageously include a pair of connector portions, for example, positioned adjacent the upper and lower end portions of the grip member 32', 34'. This advantageously allows the grip member 30' to be unobstructed by the first connector portion 110. The first connector portion 110 can also advantageously be adhesively attached to portions of the first bow 70, i.e., closely adjacent the grip member 38'. The grip member 30' can advantageously include a first side 31' positioned closely adjacent a user so that the user can grip the high impact bow 22'. The grip member 30' can also advantageously include a second side 33' positioned substantially opposite the first side 31'. The first connector 110 can further be positioned adjacent the second side 33' of the grip member 30'.

The high impact bow 22' can further advantageously include a second bow 80 having a medial body portion 81. The medial body portion 81 can advantageously include upper and lower end portions 82, 83. The second bow 80 can also advantageously include an upper arm 84 extending at a first predetermined angle $\theta_1$ outwardly from a medial body portion 81 and a lower arm 87 extending at a second predetermined angle $\theta_2$ outwardly from the medial body portion 81. More particularly, the upper arm 84 can extend at a first predetermined angle $\theta_1$ outwardly from an upper end portion of the medial body portion 82 and the lower arm 87 can extend at a second predetermined angle $\theta_2$ outwardly from a lower end portion of the medial body portion 83. The first and second predetermined angles $\theta_1$, $\theta_2$, for example, advantageously can be substantially similar so as to advantageously provide uniformity throughout the second bow 80, but the first and second predetermined angles $\theta_1$, $\theta_2$ can also be dissimilar if so desired.

Figure 8:
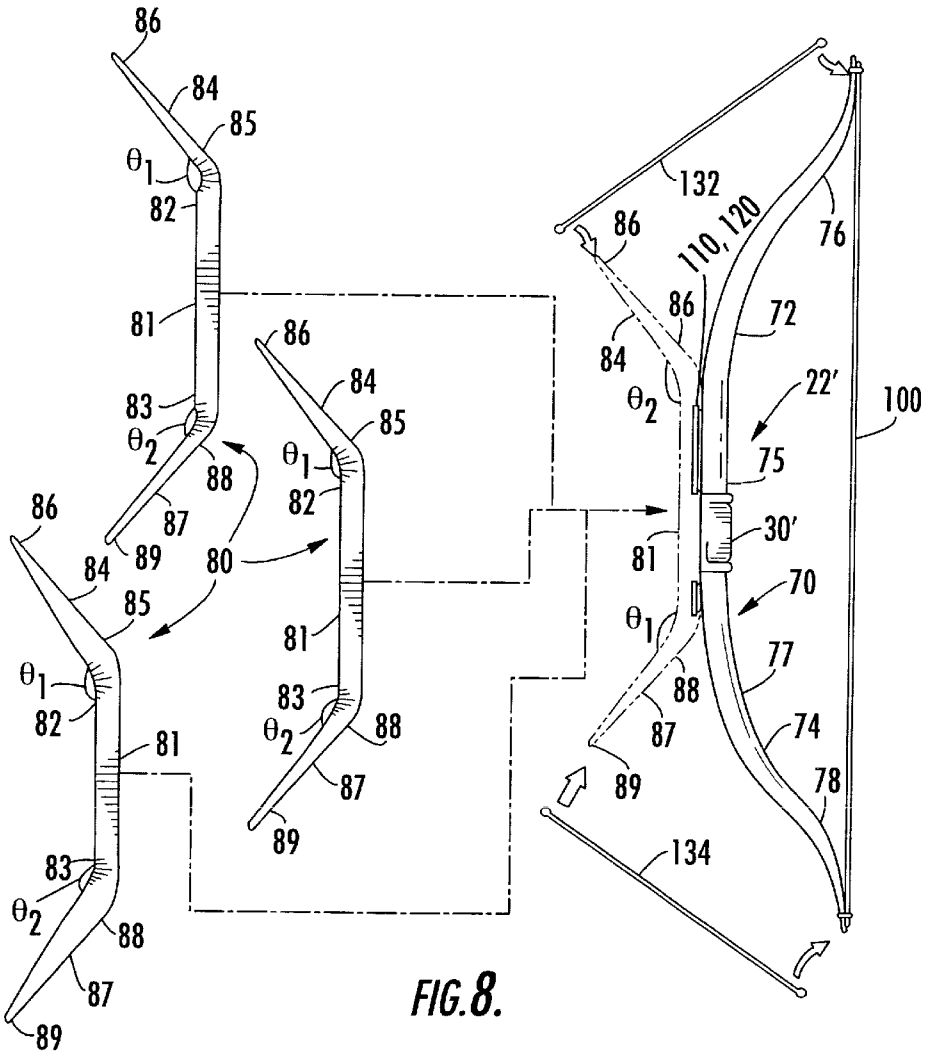
FIG. 8 is an exploded side elevation view of one of a plurality of second bows being positioned on a first bow to form a high impact bow according to the present invention.

As perhaps best illustrated in FIG. 8, the high impact bow 22' can further advantageously include a plurality of second bows 80 adapted to be connected to the first bow 70. Each of the plurality of second bows 80 can advantageously have different sizes, shapes, and strengths, for example, so that the connection of each one of the plurality of second bows 80 will produce a high impact compound conversion bow having various range capabilities. For example, if a first one of the plurality of second bows 80 has very high strength properties, then it is likely to be capable of firing an elongate arrow 26' farther than another one of the plurality of second bows 80 that has lower strength properties. This advantageously provides a user with many options as to the strength and range of the high impact bow 22'.

The upper and lower arms 84, 87 can advantageously include proximal 85, 88 and distal 86, 89 end portions. The proximal end portion of the upper arm 85 preferably is positioned closely adjacent the upper end portion of the medial body portion 82 and the proximal end portion of the lower arm 88 is positioned closely adjacent the lower end portion of the medial body portion 83. The distal end portions of the upper and lower arms 86, 89 can advantageously be positioned opposite the respective proximal end portions of the upper and lower arms 85, 88. The upper and lower arms of the second bow 84, 87 can advantageously include similar shapes and sizes.

The second bow 80 can also advantageously include a second connector 120 positioned adjacent the medial body portion 81. As best illustrated in FIG. 9, the second connector 120 can advantageously be connected to the medial body portion of the second bow 80 using a fastener, such as a screw positioned to extend through the medial body portion of the second bow 81 or an adhesive, for example, or any other fastener as understood by those skilled in the art. The second connector 120 is further adapted to matingly engage the first connector 110 positioned adjacent the grip member 38' on the first bow 70. The first and second connectors 110, 120 can, for example, form a male/female connection, such as a tongue and groove connection, i.e., the first connector 110 is the tongue portion and the second connector 120 is the groove portion. The first and second connectors 110, 120 can also form a snap lock connection, for example, or any other type of connection that would securely fasten the first and second bows 70, 80 together as understood by those skilled in the art.

The high impact bow 22' can also advantageously include a pair of compound draw strings 130. The first one of the pair of compound draw strings 130 can be an upper compound draw string 132 connected between the respective distal end portions of the respective upper arms of the first and second bow 76, 86. The second one of the pair of compound draw strings preferably is a lower compound draw string 134 connected between the respective distal end portions of the respective lower arms of the first and second bow 78, 89 so that the combination of the first and second bows 70, 80 form a high impact compound conversion bow. Each of the pair of compound draw strings 132, 134 can advantageously include a loop 131 adapted to be positioned over the distal end portions of the upper and lower arms 86, 89 of the second bow 80.

Figure 7:
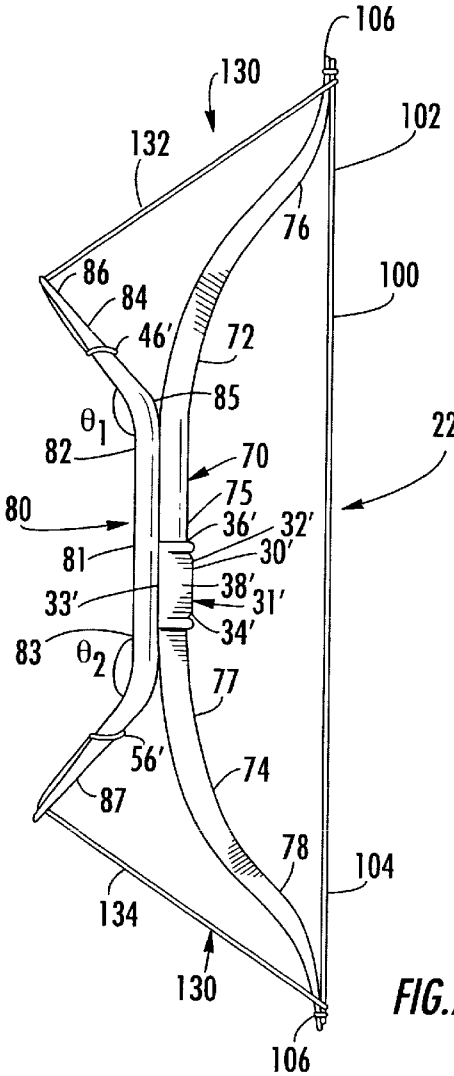
FIG. 7 is a side elevation view of a second embodiment of high impact bow according to the present invention.

More particularly, as illustrated in FIGS. 7–8, the loop 131 on each of the pair of compound draw strings 132, 134 can advantageously be adapted to engage draw string receivers positioned on the respective upper and lower arms 46', 56'. The draw string receivers 46', 56' can advantageously be provided by notches, for example, positioned along the distal end portions of the upper and lower arms 86, 89 of the second bow 80. The draw string receivers 46', 56' advantageously secure each of the pair of compound draw strings along portions of the second bow 80. The pair of compound draw strings 132, 134 can advantageously be made of nylon, or any other type of material having high strength and flexibility properties as understood by those skilled in the art.

The pair of compound draw strings 132, 134 are positioned so that when the primary draw string 100 is extended into a tension enhanced position 67', i.e., pulled back, each of the pair of compound draw strings 132, 134 will responsively move into a tension enhanced position to thereby enhance the tension on the upper and lower arms of the second bow 84, 87. When the high impact bow 22' is positioned in the tension enhanced position 67', an elongate arrow 26' can advantageously be positioned to engage the primary draw string 100 to be fired. When the primary draw string 100 is released, the pair of compound draw strings 132, 134 will also be released and the elongate arrow 26' is responsively fired. The primary draw string 100 advantageously releases a predetermined amount of energy that is used to fire the elongate arrow 26'. The amount of energy that is released depends upon the distance that the primary draw string 100 is extended. The pair of compound draw strings 132, 134 enhance the energy released by the primary draw string 100 by increasing the force with which the elongate arrow 26' is fired, i.e., when the primary draw string 100 is released and the pair of compound draw strings 132, 134 are responsively released, the pair of compound draw strings 132, 134 pull the distal end portions of the upper and lower arms of the first bow 76, 78 so that the energy of the primary draw string 100 is released faster. This advantageously allows a user to fire an elongate arrow 26' a great distance farther and at a higher rate of speed then if fired without the use of the pair of compound draw strings 132, 134. This also advantageously allows a user to fire the elongate arrow 26' without extending the primary draw string 100 as far as would be necessary if not using the pair of compound draw strings 132, 134.

Figure 6:
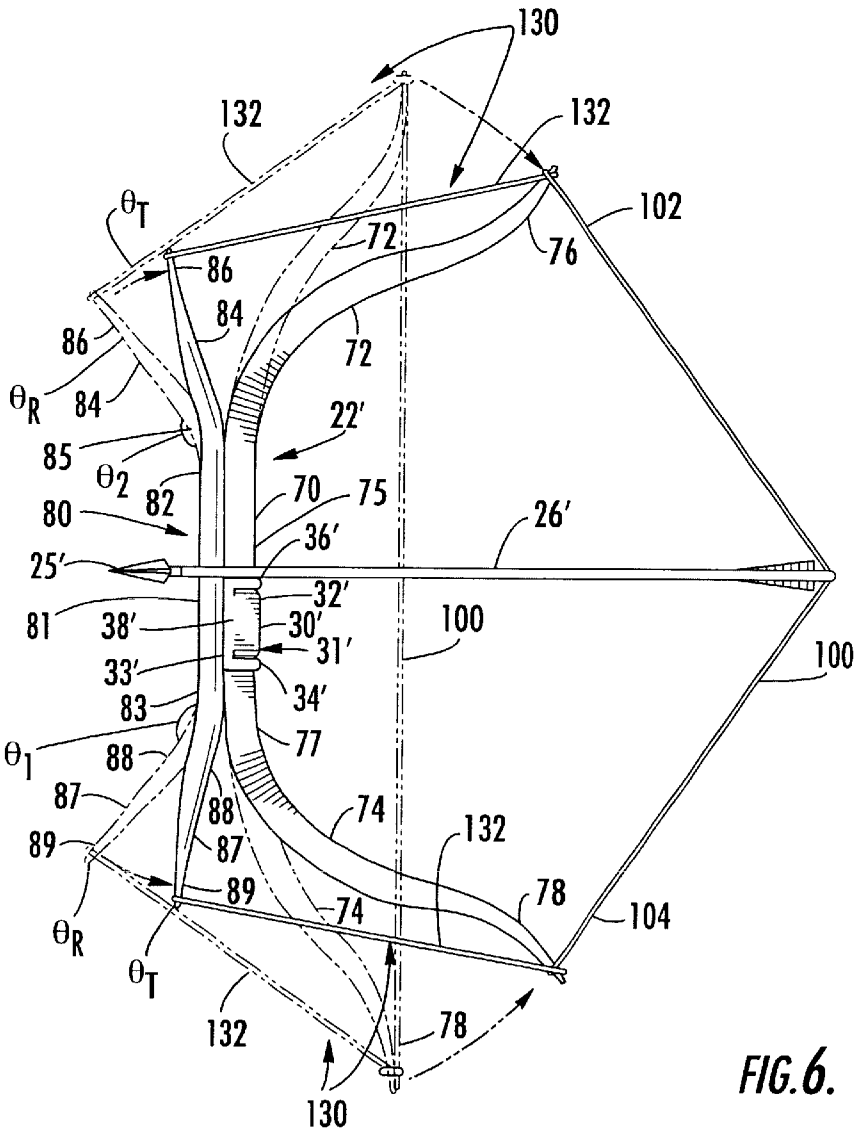
FIG. 6 is a side elevation view of a second embodiment of a high impact bow having an elongate arrow positioned therein according to the present invention.
Figure 5:
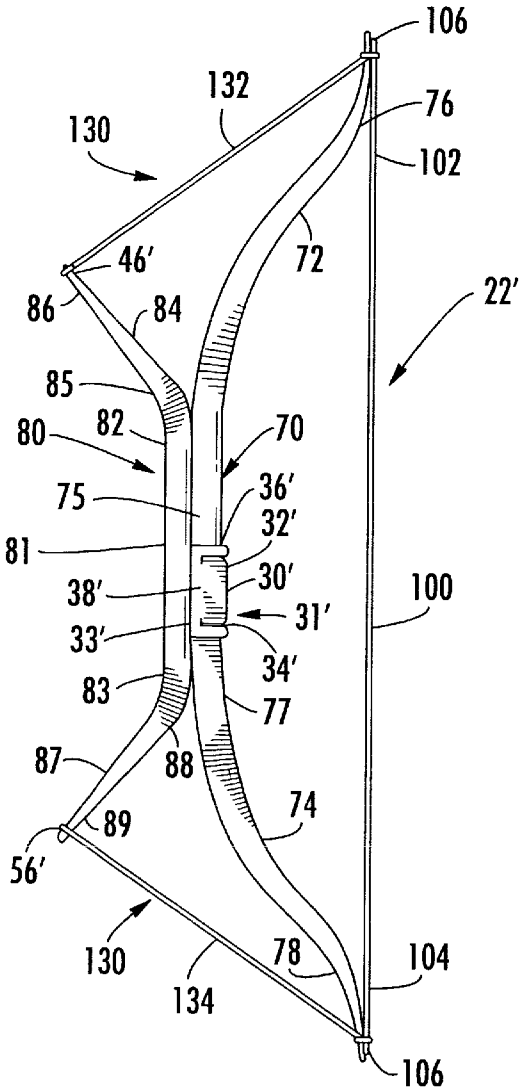
FIG. 5 is a side elevation view of second embodiment of a high impact bow according to the present invention.

As best illustrated in FIG. 6, each of the first and second predetermined angles $\theta_1$, $\theta_2$ can advantageously include a first at-rest angle $\theta_R$ and a second tension enhanced angle $\theta_T$. The first at-rest angle $\theta_R$ is achieved when the primary draw string 100 is not extended, i.e., positioned at rest. The first at-rest angle $\theta_R$ can, for example, be approximately 135° measured from the outer side of the medial body 81 of the second bow 80, i.e., the side of the medial body 80 positioned opposite the second connector 120. The second tension enhanced angle $\theta_T$ is achieved when the primary draw string 100 is in a tension enhanced position. The second tension enhanced angle $\theta_T$ can, for example, be approximately 175° also measured from the outer side of the medial body 81 of the second bow 80. When the primary draw string 100 is extended, i.e., pulled back, and moved into the tension enhanced position, the pair of compound draw strings 132, 134 are responsively extended and moved into a similar tension enhanced position. This applies a force to the distal end portions of the upper and lower arms of the second bow 86, 89, thereby increasing the angle between the upper and lower arms 84, 87 and the medial body portion of the second bow 81. The first at-rest angle $\theta_R$ and the second tension enhanced angle $\theta_T$ of the second bow 80 can advantageously be substantially similar so as to provide uniformity throughout the second bow 80, but can also be dissimilar if so desired.

The upper arm of the first bow 72 can advantageously be longer than the upper arm of the second bow 84. Similarly, the lower arm of the first bow 74 can advantageously be longer than the lower arm of the second bow 87. This advantageously provides a second bow 80 that is smaller in size than the first bow 70 so that the high impact compound conversion bow is not cumbersome and is easy to handle. The high impact compound conversion bow is also advantageous because it allows for a prior art simple bow 90 to be readily converted into a compound bow to thereby fire elongate arrows 26 farther and faster than prior art arrows 99 fired from a prior art simple bow 90. This is advantageously economically efficient and also advantageously reduces waste associated with replacing a simple bow 90 with a compound bow.

The present invention further advantageously includes methods of firing an elongate arrow 26 from a high impact bow 22. A method can advantageously include gripping a high impact bow 22 along a grip member 30 positioned along a lower portion of the high impact bow 22. The method can also advantageously include engaging the elongate arrow 26 with a draw string 60 of the high impact bow 22. The method can further advantageously include extending, i.e., pulling back, the draw string 60 along the lower portion of the body of the high impact bow 22 so that the draw string 60 can be drawn further than if extending the draw string 60 from a medial portion of the high impact bow 22. The step of pulling the draw string 60 back can further advantageously include the substantially bending the lower portion of the body of the high impact bow 22. The method can further advantageously include releasing the draw string 60 having the elongate arrow 26 engaged therewith to thereby project the elongate arrow 26 outwardly away from the high impact bow 22.

The present invention can also include a method of using a high impact bow 22'. The method can advantageously include matingly connecting a first connector 110 of a first bow 70 to a second connector 120 of a second bow 80. The step of matingly connecting the first connector 110 of the first bow 70 to the second connector 120 of the second bow 80 can advantageously include sliding portions of the first connector 110 into portions of the second connector 120. The method can also advantageously include connecting respective distal end portions of respective upper 76, 86 and lower 78, 89 arms of the respective first and second bows 70, 80 with respective upper and lower compound draw strings 132, 133. The method can also advantageously include connecting the distal end portion of the upper arm of the first bow 76 to the distal end portion of the lower arm of the first bow 78 with a primary draw string 100. The method can further advantageously include engaging an elongate arrow 26' with the primary draw string 100 and applying tension to the primary draw string 100 before firing an elongate arrow 26'. The method can still further advantageously include bending upper and lower portions of the second bow 86, 87 when applying tension to the primary draw string 100 of the first bow 70. The method can also advantageously include releasing the primary draw string 100 to thereby disengage the elongate arrow 26' from the primary draw string 100.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That claimed is:

1. A high impact bow system for firing an elongate arrow, the high impact bow system comprising:

a high impact bow having a grip member, the grip member including an upper end portion and a lower end portion positioned substantially opposite the upper end portion, an upper arm extending outwardly from the upper end portion of the grip member, the upper arm having a distal end portion and a first predetermined length, a lower arm extending outwardly from the lower end portion of the grip member, the lower arm having a distal end portion and a second predetermined length that is substantially shorter than the first predetermined length of the upper arm to thereby define the upper arm as a longer upper arm and the lower arm as a shorter lower arm, and a draw string connected to the distal end portions of the longer upper arm and the shorter lower arm; and an elongate arrow adapted to be fired at a high rate of travel from the high impact bow.

2. The high impact bow system as defined in claim 1, wherein the shorter lower arm is substantially more flexible than the longer upper arm so that the distal end portions of the respective upper and lower arm are extended a substantially similar distance when the draw string is extended.

3. The high impact bow system as defined in claim 2, wherein the upper end portion of the grip member includes a substantially flat surface region so that the elongate arrow can be positioned to rest thereon before being fired.

4. The high impact bow system as defined in claim 3, wherein a uniform tension is applied to the draw string when extended before the elongate arrow is fired therefrom.

5. The high impact bow system as defined in claim 4, wherein the elongate arrow further comprises a lightweight body.

6. A high impact bow for firing an elongate arrow at a high rate of travel, the high impact bow comprising:

a grip member having an upper end portion and a lower end portion positioned substantially opposite the upper end portion;

an upper arm extending outwardly from the upper end portion of the grip member, the upper arm having a distal end portion and a first predetermined length;

a lower arm extending outwardly from the lower end portion of the grip member, the lower arm having a distal end portion and a second predetermined length that is substantially shorter than the first predetermined length of the upper arm; and a draw string connected to the respective distal end portions of the upper arm and the lower arm.

7. The high impact bow as defined in claim 6, wherein the lower arm is further defined as a shorter lower arm and wherein the upper arm is further defined as a longer upper arm.

8. The high impact bow as defined in claim 7, wherein the shorter lower arm is substantially more flexible than the longer upper arm so that the distal end portions of the respective upper and lower arm are extended a substantially similar distance when the draw string is extended.

9. The high impact bow as defined in claim 8, wherein the upper end portion of the grip member includes a substantially flat surface region so that an elongate arrow can be positioned to rest thereon before being fired.

10. The high impact bow as defined in claim 9, wherein a uniform tension is applied to the draw string when extended before the elongate arrow is fired therefrom.

11. A method of firing an elongate arrow from a high impact bow, the method comprising:

gripping a high impact bow along a lower portion of the body thereof;

engaging the elongate arrow with a draw string of the high impact bow; and pulling the draw string back along the lower portion of the body of the high impact bow so that the draw string can be drawn further than if drawn from a medial portion of the body of the high impact bow.

12. The method as defined in claim 11, further comprising releasing the draw string having the elongate arrow engaged therewith to thereby project the elongate arrow outwardly away from the high impact bow.

13. The method as defined in claim 12, wherein the step of pulling the draw string back along the lower portion of the body of the high impact bow further comprises substantially bending the lower portion of the body of the high impact bow.

* * * * *